US005448271A

United States Patent [19]

Yamaguchi et al.

[11] Patent Number: 5,448,271

[45] Date of Patent: Sep. 5, 1995

[54] RECOVERY METHOD FOR INK JET RECORDING HEAD

[75] Inventors: Hideki Yamaguchi, Yokohama; Takashi Nojima, Tokyo; Shinya Matsui, Yokohama, all of Japan

[73] Assignee: Canon Kabushiki Kaisha, Tokyo, Japan

[21] Appl. No.: 145,049

[22] Filed: Nov. 3, 1993

Related U.S. Application Data

[60] Continuation of Ser. No. 920,672, Jul. 28, 1992, abandoned, which is a division of Ser. No. 845,796, Mar. 9, 1992, Pat. No. 5,153,613, which is a continuation of Ser. No. 574,064, Aug. 29, 1990, abandoned.

[30] Foreign Application Priority Data

| | | | |
|---|---|---|---|
| Aug. 31, 1989 | [JP] | Japan | 1-226322 |
| Aug. 31, 1989 | [JP] | Japan | 1-226323 |
| Dec. 8, 1989 | [JP] | Japan | 1-319717 |

[51] Int. Cl.[6] ..... B41J 2/165

[52] U.S. Cl. ..... 347/30; 347/32

[58] Field of Search ..... 347/29, 30, 32

[56] References Cited

U.S. PATENT DOCUMENTS

| | | | |
|---|---|---|---|
| 4,739,340 | 4/1988 | Terasawa | 347/30 |
| 4,745,414 | 5/1988 | Okamura et al. | 347/30 |
| 4,893,138 | 1/1990 | Terasawa et al. | 347/30 |
| 4,951,066 | 8/1990 | Terasawa et al. | 347/33 |
| 4,970,534 | 11/1990 | Terasawa et al. | 347/32 |
| 5,086,305 | 2/1992 | Terasawa | 347/86 |
| 5,153,613 | 10/1992 | Yamaguchi et al. | 347/30 |
| 5,311,214 | 5/1994 | Hirasawa et al. | 347/30 |

FOREIGN PATENT DOCUMENTS

| | | | |
|---|---|---|---|
| 3611333 | 10/1986 | Germany . | |
| 61-071443 | 5/1986 | Japan | B41J 3/04 |
| 61-277456 | 12/1986 | Japan | B41J 3/04 |
| 61-277457 | 12/1986 | Japan | B41J 3/04 |
| 61-277458 | 12/1986 | Japan | B41J 3/04 |
| 63-224958 | 9/1988 | Japan | B41J 3/04 |
| 2184066 | 6/1987 | United Kingdom . | |

*Primary Examiner*—Joseph W. Hartary

*Attorney, Agent, or Firm*—Fitzpatrick, Cella, Harper & Scinto

[57] ABSTRACT

In a suction recovery method in a liquid jet recording apparatus in which the discharge port surface of a recording head is capped by a cap in response to the movement of a carriage carrying the recording head thereon and which is provided with an atmosphere release valve for introducing the atmosphere into the cap after or during the suction of ink from the discharge ports, provision is made of one or more rails disposed on the back of the cap in parallel to the direction of movement of the carriage, and driving means for providing a time difference between the timing of the capping drive of the cap and the valve closing timing of the atmosphere release valve in response to the movement of the carriage to the suction recovery position.

12 Claims, 12 Drawing Sheets

RECOVERY METHOD FOR INK JET RECORDING HEAD

This application is a continuation of application Ser. No. 07/920,672 filed Jul. 28, 1992, now abandoned, which in turn is a division of application Ser. No. 07/845,796, filed Mar. 9, 1992, now U.S. Pat. No. 5,153,613, which is a continuation of U.S. patent Appln. Ser. No. 07/574,064, filed Aug. 29, 1990, now abandoned.

BACKGROUND OF THE INVENTION

1. Field of the Invention

This invention relates to a suction recovery device in a liquid jet recording apparatus, and more particularly to a suction recovery device for preventing the clogging of the discharge ports of a liquid jet recording apparatus, in which recording liquid droplets are caused to fly to effect recording, due to the evaporation or the like of ink.

2. Related Background Art

It is a well-known technique as disclosed in U.S. Pat. No. 4,745,414 to effect pressing recovery and suction recovery from a recording head through a cap member, and to thereafter open the interior of the cap member to the atmosphere and introduce waste ink into the absorbing member of an ink collecting portion. Particularly, this introduction is called idle suction and is described in detail in U.S. Pat. No. 4,739,340.

On the other hand, during the capping process of rendering the cap closed relative to the recording head, air is introduced into the recording head with the pressing by the cap, and the suction and pressing recovery technique utilizing this is an excellent recovery technique disclosed in GB UK Patent Application 2,184,066.

However, there has been no simple and inexpensive construction for changing over the interior of the cap from the closed state to the opened state.

SUMMARY OF THE INVENTION

It is a primary object of the present invention to provide a suction recovery device which can accomplish the recovery process within a short time and moreover can be simplified in construction.

It is another object of the present invention to provide a recording apparatus which can be made compact and yet can be improved in the throughput of a mechanism for changing over the interior state of a cap.

It is still another object of the present invention to provide a recording apparatus in which timing control of high accuracy utilizing a capping mechanism is simply carried out.

Further objects of the present invention will be understood from the following detailed description of some embodiments of the invention.

DESCRIPTION OF THE PREFERRED EMBODIMENTS

Figure 1:
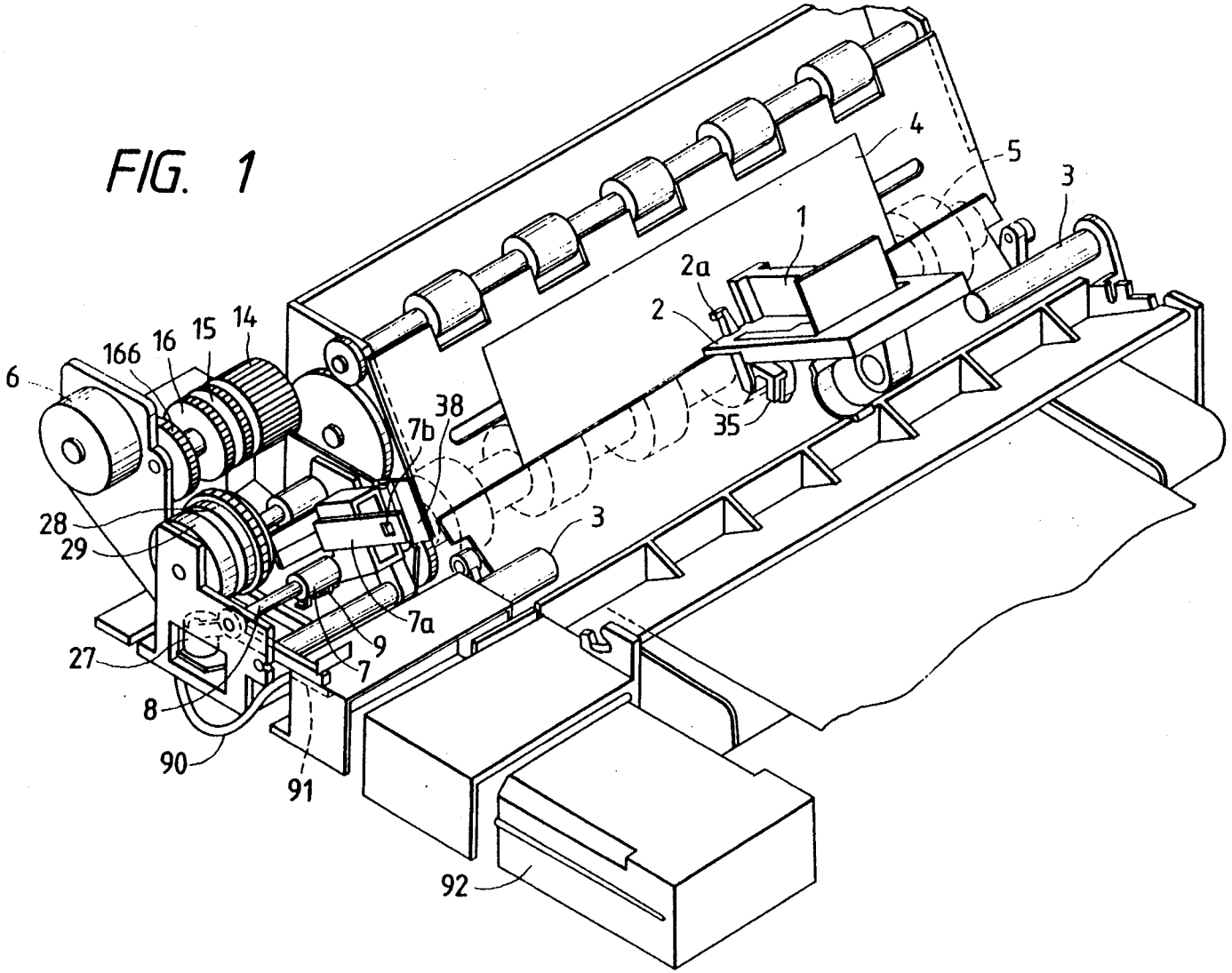
FIG. 1 is a perspective view showing an embodiment of a suction recovery device in a liquid jet recording apparatus according to the present invention.

Reference is had to FIGS. 1 to 11 to describe embodiments of a suction recovery device in a liquid jet recording apparatus wherein the discharge port surface of a recording head is capped by a cap in response to the movement of a carriage carrying said recording head thereon and provision is made of an atmosphere release valve for introducing the atmosphere into said cap after the suction of ink from the discharge port, and wherein provision is made of one or more rails disposed in the back of said cap in parallel to the direction of movement of said carriage, and driving means for providing a time difference between the capping drive timing of said cap and the valve closing timing of said atmosphere release valve in response to the movement of said carriage to the suction recovery position.

The driving means, as a means for simplifying its construction, may be means for delaying the valve closing timing of said atmosphere release valve with respect to the capping drive timing of said cap.

Further, as this means for delaying the timing, it is desirable to provide a level difference portion whose fore end portion bulges toward the head on said rail portion which responds to said two driving timings.

As the shape of this level difference portion, it is preferable that where said rails are plural, the level difference portion of the rails for the capping drive of said cap be provided more toward the printing area relative to the level difference portion of the rails for the valve closing of said atmosphere release valve or the level difference portion of the rails for the valve closing of said atmosphere release value be provided at the same position as the level difference portion of the rails for the capping drive of said cap and the angle of inclination thereof be made gentle.

According to the above-described means, an actuating member (arm) is provided for driving the cap and the atmosphere release valve beam against the rails with a time difference in response to the movement of the carriage to the suction recovery area. Accordingly, it becomes possible to effect the capping drive of the cap and the valve closing drive of the atmosphere release valve without an exclusive actuating member of complicated construction operable in response to the movement of the carriage being provided on each of the cap and the atmosphere release valve.

Design is made such that the capping drive of the cap is effected prior to the valve closing drive of the atmosphere release valve, whereby the atmosphere release valve is closed after the capping of the cap, and during the capping, the interior of the cap is pressurized to thereby prevent the discharge ports from being pressurized and the release of the atmosphere in the cap after suction recovery can be effected prior to the opening operation of the cap.

A level difference for effecting an operation conforming to the capping drive of the cap and the value drive of the atmosphere release valve is provided on the rails, whereby the pressing drive to the actuating member for the cap is first performed and capping is effected, and then the valve closing of the atmosphere release value is effected. After the termination of suction recovery, the valve opening operation of the atmosphere release valve is performed, whereafter the opening operation of the cap is performed. Accordingly, a series of operations for suction recovery can be automatically performed in conformity with the movement of the carriage and the state of contact of each member with the rails.

[First Embodiment]

Figure 2:
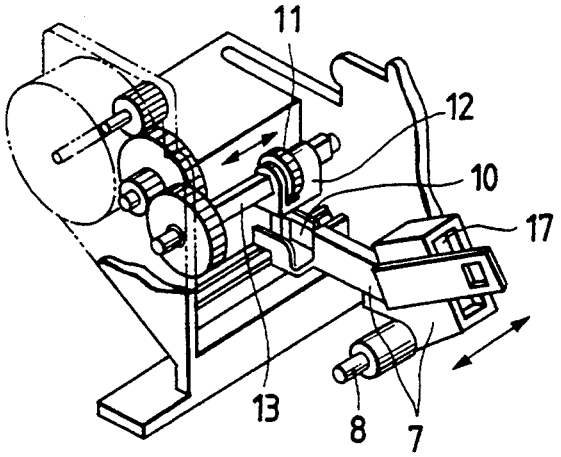
FIGS. 2 and 3 are perspective views of a gear mechanism illustrating the change-over of the paper feed driving and the cap driving.
Figure 3:
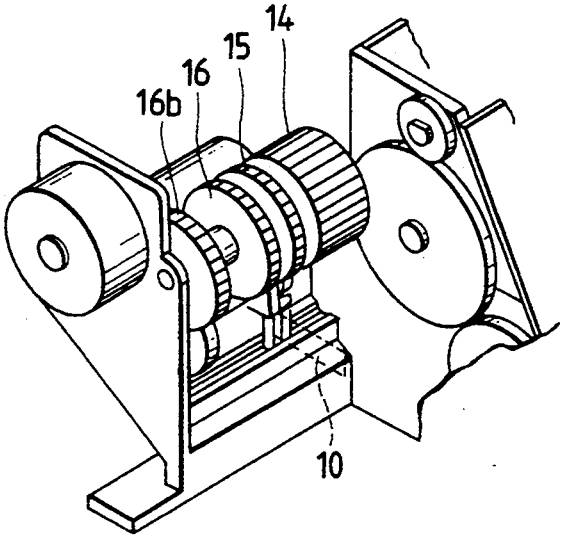
Figure 4:
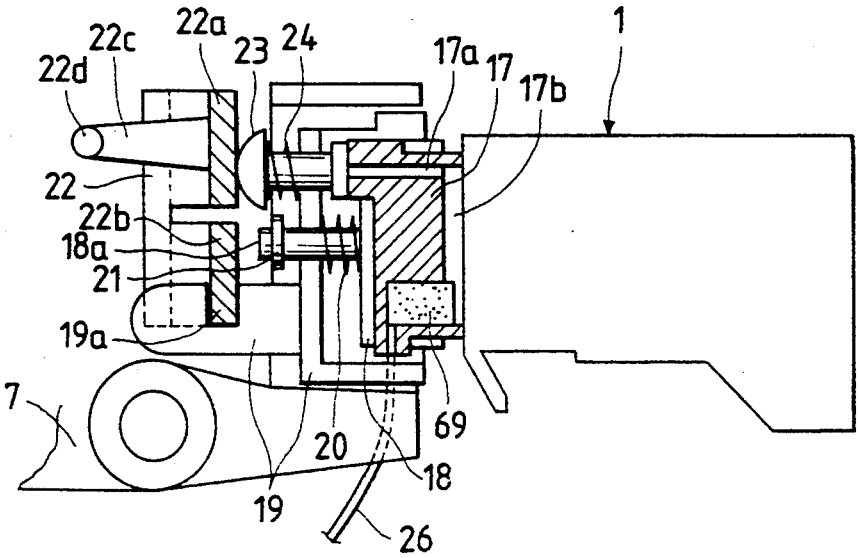
FIG. 4 is a cross-sectional view showing the details of a capping unit.
Figure 5:
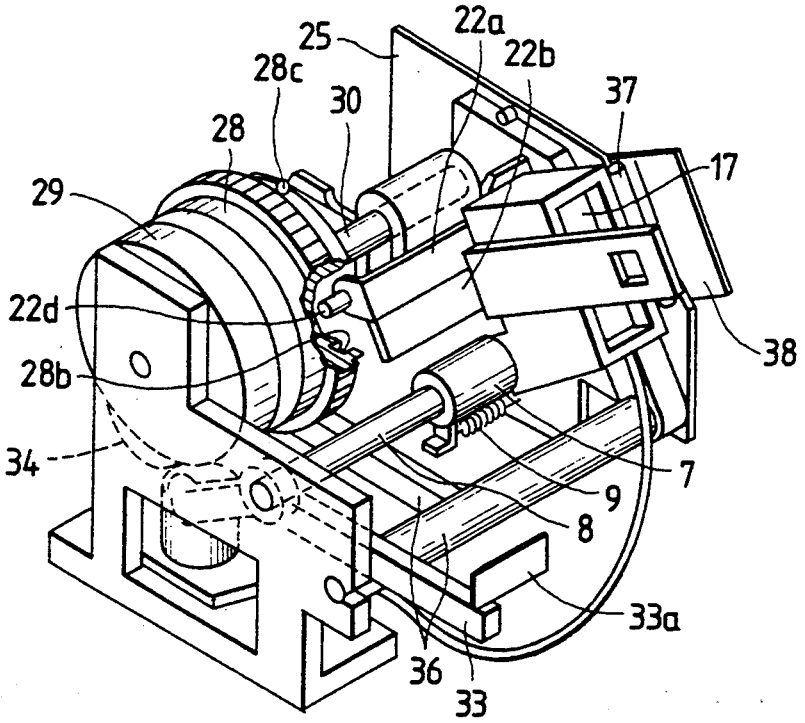
FIGS. 5 and 6 are perspective views showing the details of the suction recovery device.
Figure 6:
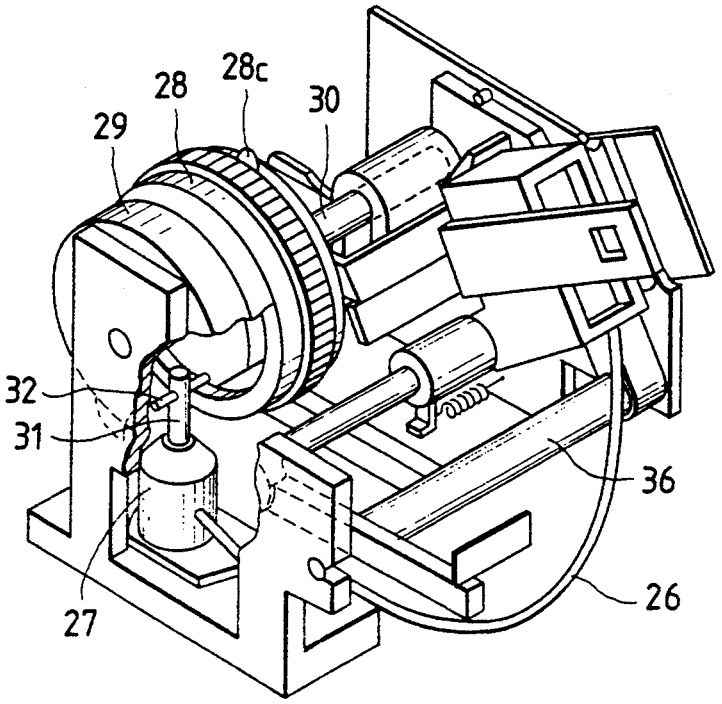
Figure 7A:
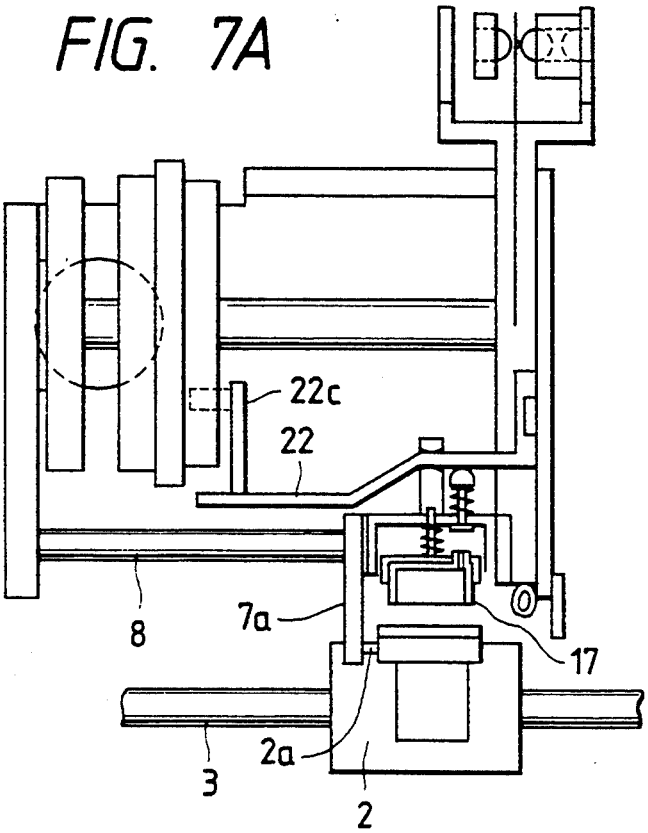
FIGS. 7A–7D are plan views illustrating the capping and the operation of an atmosphere release valve.
Figure 7B:
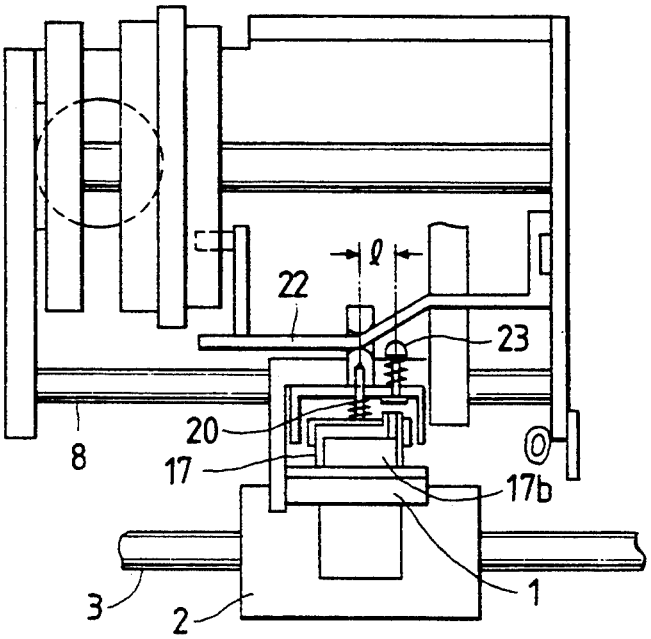
Figure 7C:
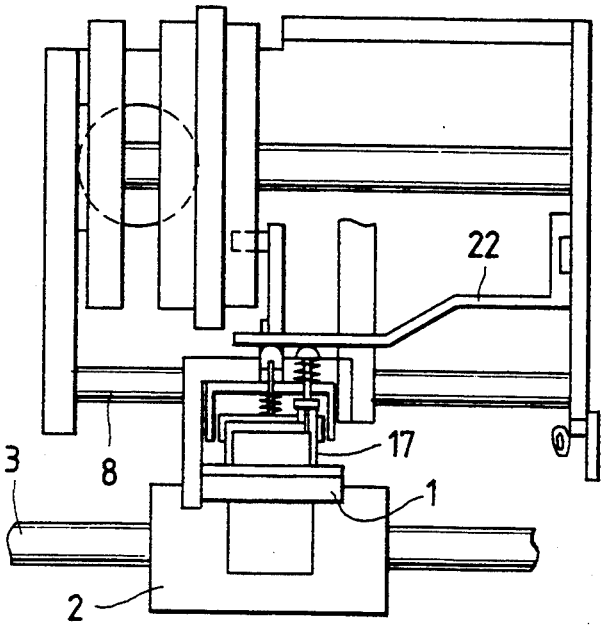
Figure 7D:
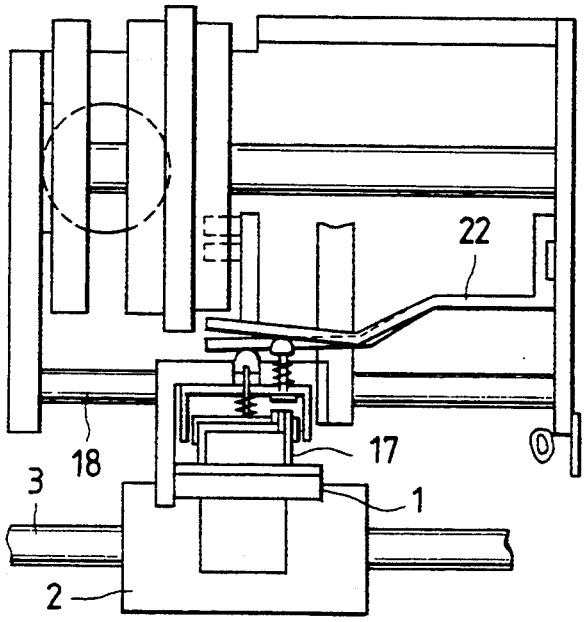
Figure 8:
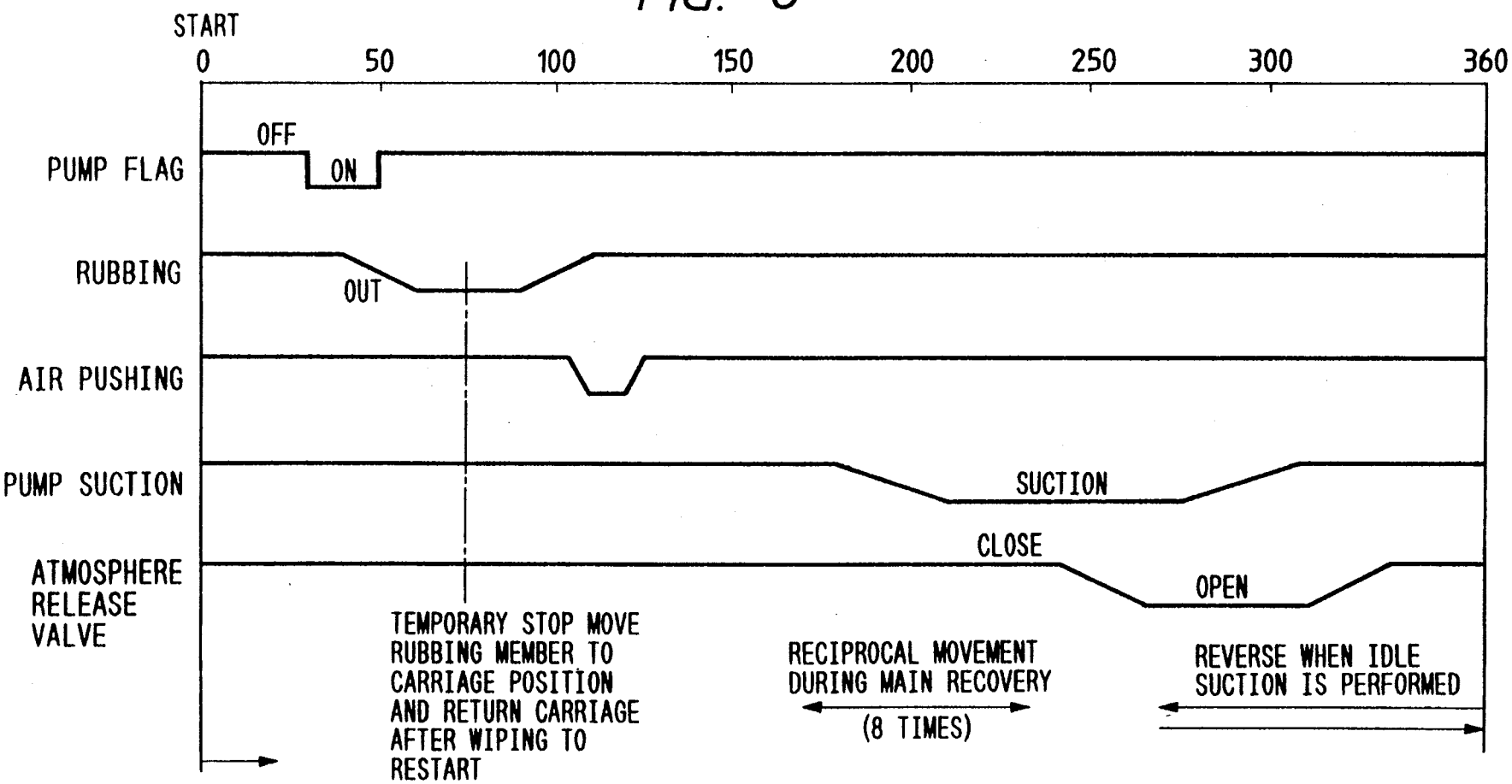
FIG. 8 is a timing chart illustrating the operation of an embodiment of the present invention.
Figure 9:
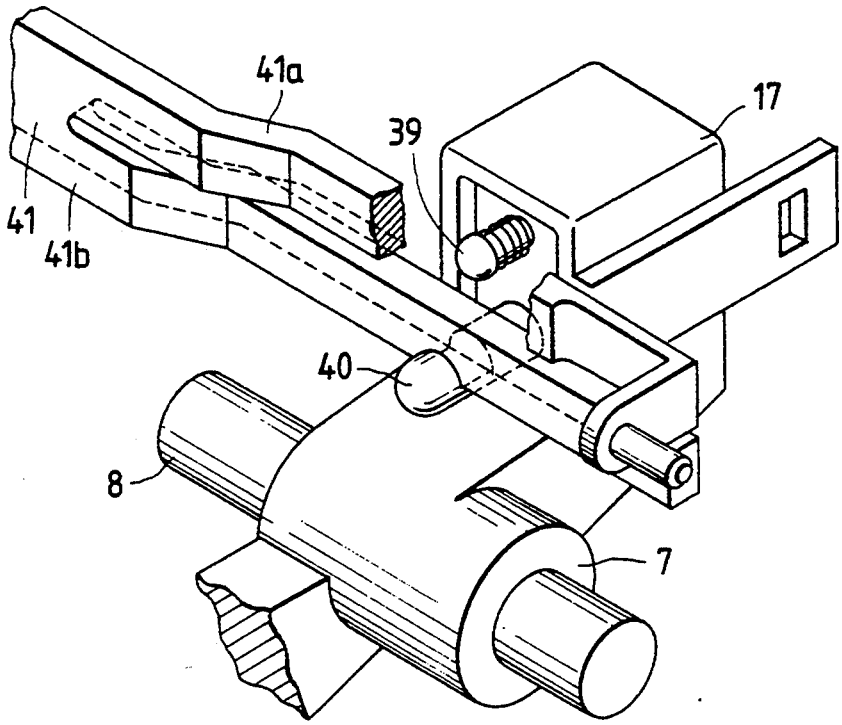
FIGS. 9 to 11 are schematic perspective views showing second to fourth embodiments of the present invention.
Figure 10:
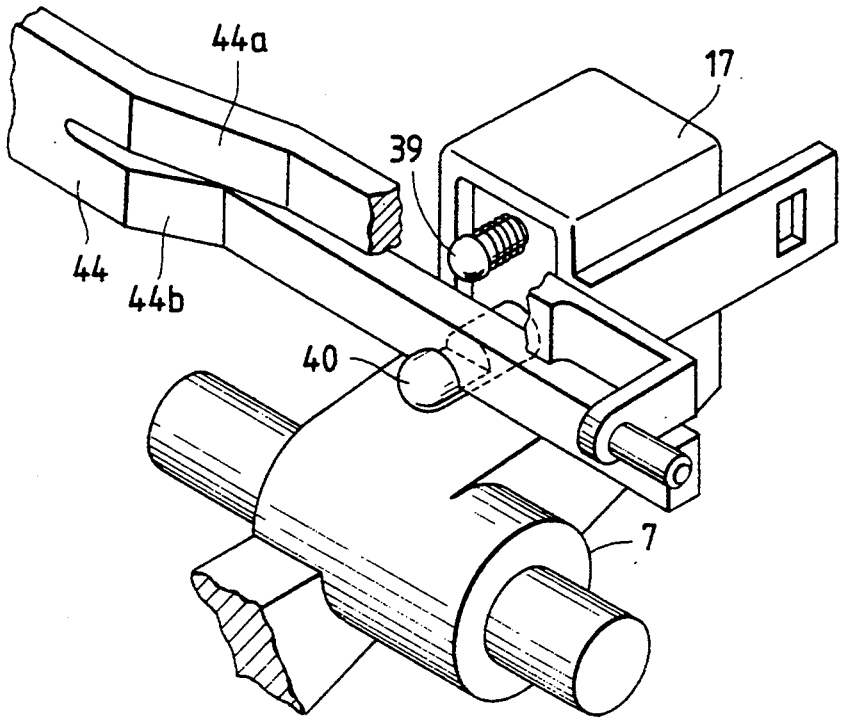
Figure 11:
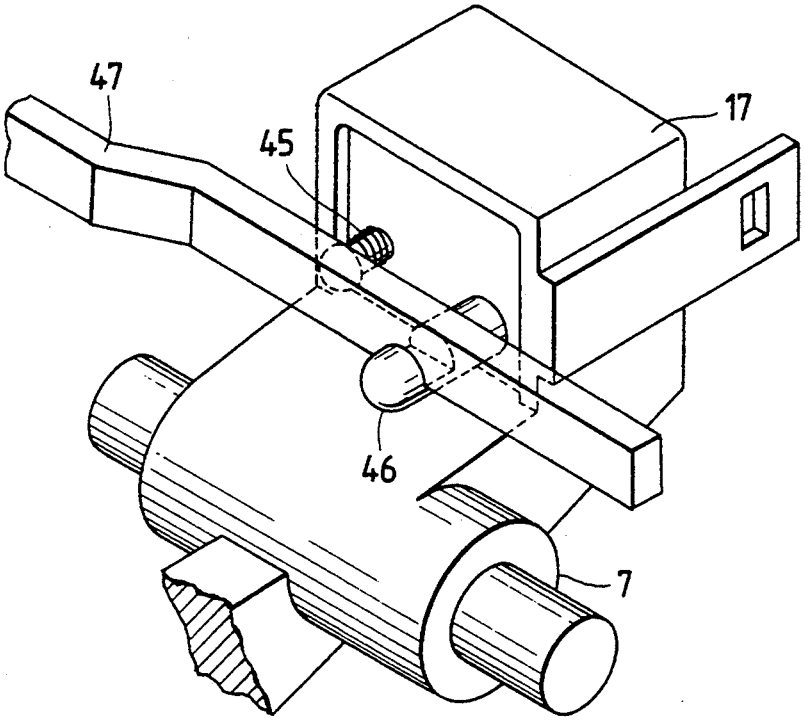

FIG. 1 is a perspective view showing an embodiment of the suction recovery device in the liquid jet recording apparatus according to the present invention, FIGS. 2 and 3 are perspective views of a gear mechanism illustrating the change-over of the paper feed driving and the cap driving, FIG. 4 is a cross-sectional view showing the details of a capping unit, FIGS. 5 and 6 are perspective views showing the details of the suction recovery device, FIGS. 7A–7D are plan views showing the capping and the operation of an atmosphere release valve 23, FIG. 8 is a timing chart illustrating the operation of an embodiment of the present invention, and FIGS. 9–11 are schematic perspective views showing second to fourth embodiments of the present invention.

Referring to FIG. 1, the reference numeral 1 designates a recording head provided with a plurality of discharge ports for discharging ink droplets therethrough in conformity with recording information by energy generating means (such as a piezo-electric element, a resistance heat generating member or the like) contained in the recording head, the reference numeral 2 denotes a carriage carrying the recording head 1 thereon and movable in the main scanning direction, the reference numeral 3 designates a carriage shaft slidably supporting the carriage 2, the reference numeral 4 denotes a recording medium and the reference numeral 5 designates a feed roller for conveying the recording medium in conformity with the recording situation.

The reference numeral 6 denotes a pulse motor which is a drive source for the feed roller 5 and for effecting automatic paper supply, the reference numeral 7 designates a pump carriage capable of recovering a cap unit and movable in parallel to the carriage shaft 3, the reference numeral 8 denotes a guide shaft for guiding the parallel movement of the pump carriage 7, and the reference numeral 9 designates a return spring for biasing the pump carriage 7 rightwardly as viewed in FIG. 1. The pump carriage 7 is provided with an arm 7*a*, in the fore end portion of which there is formed an aperture 7*b* into which a projection 2*a* provided on the right side of the carriage can fit. The projection 2*a* fits into the aperture 7*b* when the carriage 2 is moved to the left, thereby preventing the carriage 2 from vertically pivoting when a cap 17 is capped on the discharge port surface of the recording head 1. As shown in FIG. 2, one end of a leaf spring 10 having resiliency in the direction of movement of the carriage is fixed to the rear of the pump carriage 7. Further, the other end of the leaf spring 10 is held so as to be nipped by a slide gear supporting bed 12 which supports a slide gear 11. The slide gear supporting bed 12 is provided for movement along a slide shaft 13 in the direction of movement of the carriage. Accordingly, the slide gear 11 is stopped in a position in which it is pressed by the resilient force of the leaf spring 10. Therefore, the carriage 2 is moved and the projection 2*a* of the carriage 2 bears against the arm 7*a* of the pump carriage 7 and is moved with the latter, whereby the slide gear 11 is moved in the direction of movement of the carriage.

The slide gear 11, as shown in FIG. 3, is in meshing engagement with a gear independently rotated in parallel to the direction of movement of the carriage. In FIG. 3, the reference numeral 14 designates a feed gear for transmitting a drive force to a sheet feed gear, the reference numeral 15 denotes an ASF (automatic sheet feeder) gear for transmitting the drive force of an ASF, and the reference numeral 16 designates a pump gear for transmitting the drive force to the suction recovery device. The pump gear 16 comprises two gears made integral with each other, and the left gear 16*b* is in meshing engagement with the pump cam 28 of the suction recovery device. Accordingly, depending on the stopped position of the carriage 2, the slide gear 11 meshes with one of the gears 14, 15 and 16 through the pump carriage 7 and the leaf spring 10 so that the drive force of the pulse motor 6 can be selectively transmitted.

FIG. 4 is a cross-sectional view showing the details of the capping unit.

The cap 17 is formed by the use of an elastic member of rubber or the like urged against the outer edge portion of the discharge port surface of the head with elasticity, and has a vent hole 17*a* and a driving space 17*b*. Also, the cap 17 is supported by a cap holder 18, which is held by a holder 19. A projection 18*a* which is like a rod having its top end portion extending through the rear wall of the holder 19 is formed on the back of the cap holder 18, and a coil spring 20 is fitted on this projection 18*a*. An E-ring 21 for regulating the movement of the cap holder 18 toward the head is mounted on the tip end portion of the projection 18*a*. The cap holder 18 is movable to the left and right as viewed in FIG. 4 relative to the holder 19 by a guide, not shown, which is provided on the holder 19, and the holder 19 is movable in the direction indicated in FIG. 4 relative to the pump carriage 7 by a guide, not shown, which is provided on the pump carriage 7.

A groove 19*a* is formed in the rear of the holder 19, and a rail 22 is inserted in the groove 19*a*. The rail 22 is divided into two upper and lower rails (in this case, the rails 22*a* and 22*b* should only move independently of each other, and a single rail may be divided into two intermediately thereof even if the two are independent of each other), and the lower rail 22*b* is used to move the holder 19 forwardly and backwardly relative to the recording head 1, and the upper rail 22*a* is used to open and close an atmosphere release valve 23. A rail arm portion 22*c* is provided on the back of the rail 22, and a rail dowel 22*d* is provided on the fore end of the rail arm portion 22*c*. The rail 22 is stopped by a pump base 25, as shown in FIG. 5.

The atmosphere release valve 23 is provided on the back of the holder 19 and is biased leftwardly by a spring 24. Accordingly, the atmosphere release valve 23 is movable to the left and right along the rail 22*a* as viewed in FIG. 4. The mounting of the atmosphere release valve 23 is accomplished by inserting it from above the holder 19 and fixing it. Also, the atmosphere release valve 23 lies in front of the vent hole 17*a* provided in the cap 17, and by this vent hole 17*a* being closed by the atmosphere release valve 23, the space 17*b* can be hermetically sealed. An ink absorbing member 69 is disposed on the bottom of the cap 17, and absorbs and retains ink during the suction of the ink to thereby prevent the desiccation of the nozzle during capping.

The rail 22 is formed of a resilient material, and when viewed from the upper portion of the printer, it is of a shape which protrudes toward the recording head 1 as shown in FIGS. 7A–7D. Accordingly, the projection 2*a* of the carriage 2 bears against the arm 7*a* of the pump carriage 7, the pump carriage 7 and the carriage 2 are moved together, the holder 19 and the atmosphere release valve 23 are moved along the shape of the rail 22, and at the stage of FIG. 7B, the cap 17 is urged against the discharge port surface of the head.

When as shown in FIG. 1, the carriage 2 is in the printing range, the pump carriage 7 is biased by the return spring 9 and bears against the side of the pump base 25 as shown in FIG. 7A. In this state, the cap 17 is in such a positional relation that it does not overlap with the recording head 1, and the atmosphere release valve 23 is not closing the vent hole 17*a*.

When the carriage 2 is then moved leftwardly beyond the printing range and the projection 2*a* bears against the arm 7*a* and the carriage 2 is further moved leftwardly, the atmosphere release valve 23 and the holder 19 move along the rails 22*a* and 22*b*, and when the carriage 2 is moved to the position of FIG. 7B, the cap 17 is urged against the discharge port surface of the recording head 1. The urging force at this time is about 300 g by the spring 20. At this time, as regards the position in which as shown in FIG. 7B, the holder 19 bears against the rail 22 and the position in which the atmosphere release valve 23 bears against the rail 22, the rail 22 deviates by a distance l in the lengthwise direction and therefore, the atmosphere release valve 23 has not climbed up the rising positions of the rails 22*a* and 22*b* and has not closed the vent hole 17*a* of the cap 17 even if the rising angle and the amount of displacement of the rail 22 remain unchanged, and therefore the space 17*b* between the cap 17 and the recording head 1 is in communication with the atmosphere and the recording head 1 is not pressed by capping and thus, the non-discharge by the recession of meniscus in the discharge port portion does not occur.

When the carriage 2 is further moved to the left and the atmosphere release valve 23 has climbed up the rail 22*a*, the atmosphere release valve 23 closes the vent hole 17*a* of the cap 17 and the space 17*b* becomes hermetically sealed. When from this state, the carriage 2 is further moved to the left and comes to the position of FIG. 7C, the slide gear 11 comes into meshing engagement with the pump gear 16 and the suction recovery device operates. At this time, a suction tube 26 is connected to the cap 17 as shown in FIGS. 4–6 and the other end thereof is connected to a cylinder 27 as shown in FIG. 5 and therefore, negative pressure produced in this cylinder 27 is directed to the space 17*b* through the suction tube 26.

By the carriage 2 being located at the position of FIG. 7C, the rotational force of the pulse motor 6 is transmitted to the pump gear 16→the gear 16*b* →the gear portion of the pump cam 28 in the named order. The pump cams 28 and 29 are made integral with a positioning dowel, not shown, and are rotatable relative to the pump cam shaft 30. Elliptical groove portions are provided in the opposed surfaces of the pump cams 28 and 29 as shown in FIG. 6 so that the opposite ends of a parallel pin 32 integrally coupled to a piston 31 may be slidable, and the parallel pin 32 moves up and down in response to the rotation of the cams to thereby move the piston 31 up and down.

Also, as shown in FIG. 5, the pump cam 29 is provided with a projection 34 for depressing one end of a pump flag 33, which is rotatable about the guide shaft 8. A transmission type sensor 35 is provided at a location opposed to the other end portion 33*a* of the pump flag 33 (the lower portion of the carriage 2 shown in FIG. 1). While the projection 34 is rotated and bears against one end of the pump flag 33, the other end portion 33*a* of the pump flag 33 intercepts light rays sent from the light emitting portion of the transmission type sensor 35 to the light receiving portion thereof, whereby from this point of time at which the light rays are intercepted, the pulse number of the pulse motor 6 is controlled and thus, the position control of the suction recovery device becomes possible.

When from this state, the projection 34 is further rotated and comes out of engagement with one end of the pump flag 33, the pump flag 33 is reversely rotated about the guide shaft 8 by the gravity thereof or the resilient force of a spring. Thus, the light rays emitted from the transmission type sensor 35 become able to be transmitted through the other end 33*a* of the pump flag 33. The pump flag 33 is stopped from rotating by a stopper, not shown, which is provided on the pump base 25. On the right side of the pump cam 28, there are provided a cam 28*b* for guiding the dowel portion 22*d* of the arm 22*c* provided on the rail 22*a* and a cam (not shown) for guiding a rubbing lever 36. The rubbing lever 36 is supported by the pump base 25 and is rotatable relative to the recording head 1. The rear of the rubbing lever 36 is guided by a cam, not shown, which is provided on the right side of the pump cam 28, and is subjected to rotation when it rides onto this cam so that a rubbing member 37 (which is provided at the right of the rubbing lever 36 and is formed, for example, of an ether polyurethane continuous porous material) can be advanced to a position in which it overlaps with the recording head 1. With the rubbing member 37 advanced, the carriage 2 is moved from left to right until it comes to the front face of the rubbing member 37, whereby ink, impurities, etc. on the discharge port surface of the recording head 1 are removed and the discharge stability of the recording head 1 is secured. The pressure contact force of the rubbing member 37 against the recording head 1 can be provided by the use of the resilient force of the rubbing member 37 itself or by a resilient member being discretely provided rearwardly of the rubbing member 37 (the pressure contact force is e.g. of the order of 100 g).

As shown in FIGS. 5 and 6, a projection 28*c* is provided on the upper portion of the pump cam 28, and this projection 28*c* presses the rear of the holder 19, whereby the rail 22*b* and the cap 17 are elastically deformed to thereby introduce air into the discharge ports and remove a minute bubble which is a cause of unsatisfactory printing. This minute bubble is discharged out of the head with a large bubble which is formed by the introduction of air. Also, when the cam 28*b* is liberated from the dowel portion 22*d* of the arm 22*c*, the rail 22*a* releases the pressure to the atmosphere release valve 23, which is thus pushed back by the resilient force of the spring 24, and atmosphere is introduced into the cap 17 which has so far been hermetically sealed.

Further, in order to secure the discharge stability of the recording head 1, a wiper 38 is provided on the right side plate of the pump base 25. This wiper 38 is, for example, a silicone rubber plate having a thickness of 0.3 mm, and is fixed so as to normally overlap with the recording head 1 (the amount of overlap thereof is e.g. 1.0 mm). Thus, whenever the recording head 1 passes the front of the wiper 38, the discharge port surface is wiped by the wiper, whereby paper powder, dust, ink dregs, etc. adhering to the discharge port surface are removed.

The recovery operation will now be described with reference to FIGS. 7A–7D and the timing chart of FIG. 8.

When a recovery operation signal is given to the CPU (or MPU) of the control unit, the carriage 2 is moved from the printing area to an area in which the suction recovery device is operable. The discharge port surface of the recording head 1 is cleaned when the head passes the front of the wiper 38 during this process of movement.

The projection 2*a* of the carriage 2 then bears against the arm portion 7*a* of the pump carriage 7, and they move leftwardly as a unit as viewed in FIG. 7A. The holder 19 and the atmosphere release valve 23 climb the inclined surfaces of the rails 22*a* and 22*b* and at first, the surface portion of the cap 17 comes into pressure contact with the recording head 1. At this time, as shown in FIG. 7B, the position in which the holder 19 and the atmosphere release valve 23 are in contact with the rail 22 deviates by l and therefore, the cap 17 is not closed and the discharge ports are not pressed and the discharge by capping does not occur.

When from this state, the carriage 2 is further moved to the left, it comes to a position in which the suction recovery device is driven. In this state, the atmosphere release valve 23 has already closed the vent hole 17*a* of the cap 17 and the space 17*b* between the recording head 1 and the cap 17 is hermetically sealed.

Hereupon, the pump cams 28 and 29 begin to rotate and at first, the projection 34 on the surface of the pump cam 29 pushes up one end of the pump flag 33 and the other end portion 33*a* of the pump flag 33 intercepts the light rays of the transmission type sensor 35 disposed in the lower portion of the carriage 2. This position is defined as the initial position of the suction recovery device and the pulse number of the pulse motor 6 is controlled. When from this state, the pump cams 28 and 29 further rotate and the projection 34 passes the pump flag 33, the pump flag 33 returns to its original position and the light rays of the transmission type sensor 35 become non-intercepted. When the pump cam 28 further rotates, the real of the rubbing lever 36 is subjected to a moment by a cam (not shown) provided on the right side of the pump cam 28, with a result that the rubbing lever 36 is subjected to rotation and the rubbing member 37 advances to a position in which it overlaps with the recording head 1. Here, the rotation of the pump cam 28 is once stopped and the carriage 2 is moved rightwardly so as to pass the rubbing member 37. At this time, the discharge port surface of the recording head 1 is rubbed by the rubbing member 37, whereby ink, solids, etc. adhering to the discharge port surface are removed.

The carriage 2 is then moved leftwardly again and is set to a position in which the driving of the suction recovery device becomes possible. Then, the pump cam 28 is rotated to press the rear of the holder 19 and the cap 17 is brought into pressure contact with the discharge port surface of the recording head 1 and further, air is introduced into the discharge ports, whereafter the piston 31 is depressed by the rotation of the pump cams 28 and 29. Negative pressure produced in the cylinder 27 at this time acts on the space formed in the cap 17, through the suction tube 26, and sucks the ink in the discharge ports. Thereby, minute bubbles in the discharge ports which are the cause of unsatisfactory discharge and dust, impurities, etc. adhering to the discharge port surface are removed.

However, if this state is kept, the ink sucked from the discharge ports of the recording head 1 remains in the cap 17 and the suction tube 26, and this ink will again adhere to the discharge port surface to cause non-discharge and the deflection of the direction of discharge, thus aggravating the accuracy of the short position of ink droplets. Also, the ink scattered when the recording head is wiped by the wiper 38 may contaminate the interior of the recording apparatus.

So, in order to solve this problem, in the present embodiment, design is made such that the dowel 22*d* provided at the fore end of the rail 22 is pulled rearwardly by the cam 28*b* and the rail 22*a* is elastically deformed and pulled rearwardly and the atmosphere release valve 23 is retracted. Thereby, the vent hole of the cap 17 is opened, the space 17*b* in the cap 17 is communicated with the atmosphere, the ink suction from the discharge ports is stopped, air flows into the cap through the vent hole 17*a* due to the negative pressure in the cylinder 27 and is sucked into the cylinder 27 with the ink in the space 17*b*. Accordingly, ink overflow does not occur in the cap 17 and the ink adhering to the discharge port surface is removed. By the pump cam 28 further rotating, the rearward pull of the rail 22*a* is released and the rail 22*a* restores its original shape by its resiliency, and the vent hole 17*a* is again closed by the atmosphere release valve 23. Thus, one sequence of recovery operation is terminated.

When ink is to be sucked in a great deal, for example, when the discharge ports are to be filled with ink from a new ink cartridge, as shown in FIG. 8, the forward and reverse rotations of the pump cam 28 are repeated before the atmosphere release valve 23 is opened, whereby the piston 31 is repetitively moved up and down so taht the ink may be continuously sucked.

Also, the cylinder 27 is pressurized when the piston 31 is moved upwardly, and the sucked ink is discharged as waste ink from a waste ink intake port 91 through a waste ink tube 90 into a waste ink reservoir (not shown) in an ink cartridge 92.

[Second Embodiment]

FIG. 9 is a schematic perspective view showing the essential portions of a second embodiment of the present invention.

The difference of this embodiment from the aforedescribed embodiment is that an atmosphere release valve 39 (having the same function as that of the atmosphere release valve 23) and a holder 40 (having the same function as that of the holder 19) are constructed so as not to deviate in the direction of movement along the rail. Thus, is in the afore-described embodiment, the two are horizontally spaced apart from each other by l, whereas in the present embodiment, the two are disposed so as to overlap with each other in the vertical direction, and are arranged so as not to have any deviation in the horizontal direction (the direction of movement along the rail). Design is also made such that the rising position of a rail 41*a* along which the atmosphere release valve 39 moves is delayed with respect to the rising position of a rail 41*b*, and at the moment of capping, the atmosphere release valve 39 has not yet climbed up the rail 41*a* and the atmosphere is in communication with the interior of the cap 17. Thereby, the pressing against the discharge ports during capping can be eliminated.

[Third Embodiment]

FIG. 10 is a schematic perspective view showing the essential portions of a third embodiment of the present invention.

In the embodiment of FIG. 9, the rising positions are made to differ from each other, whereas in this embodiment, the rising angles of the rails 44*a* and 44*b* of a rail 44 are made to differ from each other so that the timing at which the atmosphere release valve 39 closes the vent hole 17*a* may be delayed in time with respect to capping.

[Fourth Embodiment]

FIG. 11 is a schematic perspective view showing the essential portions of a fourth embodiment of the present invention.

In this embodiment, the end portion of the rail is not divided so that with the rail kept single, an atmosphere release valve 45 and a holder 46 may be driven, and the atmosphere release valve 45 and the holder 46 are installed with a sufficient spacing kept therebetween. By such a construction, the plan view movement of the atmosphere release valve 45 can be delayed in time with respect to capping. The present embodiment enables the shape of the rail to be simplified, and becomes easy to manufacture.

The suction recovery device in the liquid jet recording apparatus common to the above-described embodiments is a suction recovery device in a liquid jet recording apparatus in which the discharge port surface of a recording head is capped by a cap in response to the movement of a carriage carrying said recording head thereon and which is provided with an atmosphere release valve for introducing the atmosphere into said cap after the suction of ink from the discharge ports and wherein provision is made of one or more rails disposed on the back of said cap in parallelism to the direction of movement of said cap, and driving means for providing a time difference between the capping drive timing of said cap and the valve closing timing of said atmosphere release valve in response to the movement of said carriage to the suction recovery position and therefore, the capping drive of the cap and the valve closing drive of the atmosphere release valve can be effected without the provision of an exclusive actuating member of complicated construction.

If in the suction recovery device in the liquid jet recording apparatus, design is made such that the valve closing timing of said atmosphere release valve is delayed with respect to the capping drive timing of said cap, the interior of the cap will be pressurized during capping, whereby the discharge ports can be prevented from being pressed.

If a level difference having its fore end portion bulged out toward the head is provided in said rail portion which responds to said two drive timings, the atmosphere release valve and the cap driving mechanism can be driven in response to the movement of the carriage to the suction recovery area.

Where said rail is plural, if the level difference portion of the rail for the capping drive of said cap is provided more toward the printing area relative to the level difference portion of the rail for the valve closing of said atmosphere release valve or the level difference portion of the rail for the valve closing of said atmosphere release valve is provided at the same location as the level difference portion of the rail for the capping drive of said cap and design is made such that the angle of inclination thereof is gentle, a series of operations for suction recovery can be automatically performed in conformity with the movement of the carriage and the state of contact of each member with the rails.

Reference is now had to FIGS. 12 to 16 to describe embodiments of a suction recovery device in a liquid jet recording apparatus in which the discharge port surface of a recording head is capped by a cap in response to the movement of a carriage carrying said recording head thereon and which is provided with an atmosphere release valve for introducing the atmosphere into said cap after the suction of ink from the discharge ports and wherein provision is made of one or more rails disposed on the back of said cap in parallelism to the direction of movement of said carriage and having resiliency, and driving means for effecting the back and forth driving of said cap and the opening-closing drive of said atmosphere release valve by the use of the pressure force of said rail or rails deformable in conformity with the contact movement of an actuating member movable in response to the movement of said carriage.

In order to provide said pressure force, it is desirable that at least the movable end side of said rail or rails be formed of an elastically deformable material. Also, a portion of said rail or rails may use a material differing from the material of the essential portion. Also, said rail or rails may be provided with at least one hinge.

Further, design may be made such that said rail or rails are moved as means for effecting the back and forth driving of the atmosphere release valve and the cap.

According to the above-described means, a cap holder moves in response to the movement of the carriage to the suction recovery area, and an arm as an actuating member provided on this cap holder and the atmosphere release valve are operated under the pressure of the rail or rails. Accordingly, it becomes possible to effect the capping drive of the cap and the valve closing drive of the atmosphere release valve without an exclusive actuating member of complicated construction which is operable in response to the movement of the carriage being provided on each of the cap and the atmosphere release valve.

At least a portion of the rail or rails is endowed with a resilient force or a hinge and the actuating member bears against that portion or the vicinity thereof, whereby the rail or rails are deformed, and a capping drive member for the cap and a drive member for the atmosphere release valve are pressed. Accordingly, a driving moment can be provided by only the rail or rails and thus, the simplification of the construction becomes possible.

Also, instead of the deformation of the rail or rails, the rail or rails can be moved in the vertical direction to thereby effect the opening-closing drive of the atmosphere release valve and therefore, likewise a driving moment can be provided by only the rail or rails and thus, the simplification of the construction becomes possible.

[Fifth Embodiment]

Figure 12:
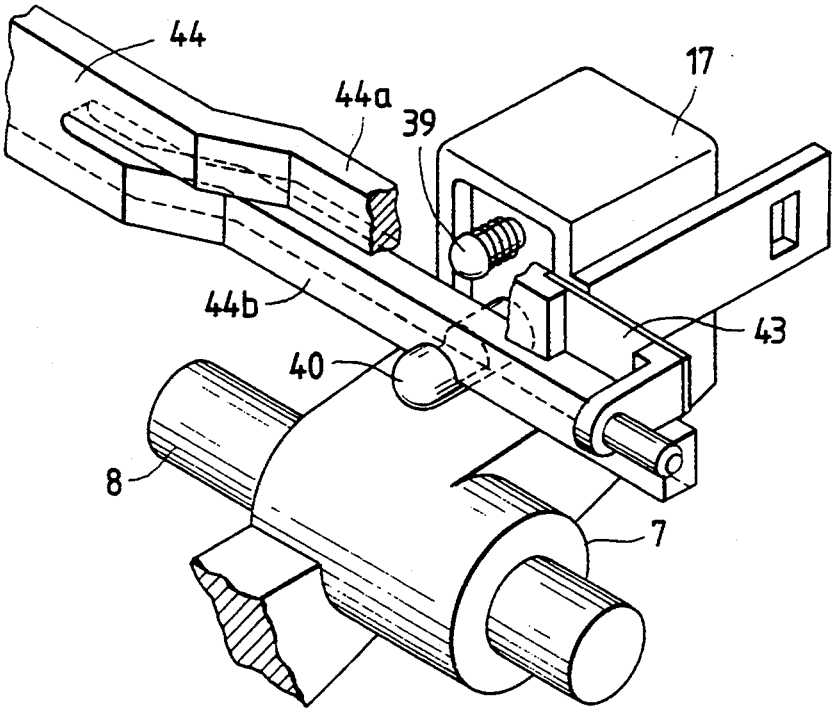
FIGS. 12 to 16 are schematic perspective views showing fifth to tenth embodiments of the present invention.

FIG. 12 is a schematic perspective view showing the essential portions of a fifth embodiment of the present invention.

This embodiment, as compared with the construction of FIG. 9 in which the fore end portion 42 is made thin, is characterized in that a resilient plate 43 of a material differing from the material of a rail 44 (which is formed of a plastic material) is provided in this portion. The material of this resilient plate 43 may be, for example, stainless steel for spring.

As in the case of FIG. 9, when the pump carriage arrives at the resilient plate 43, an atmosphere release valve 39 is pressed under the resilient deformation of the resilient plate and the valve is closed. During the driving of the atmosphere release valve 39, the rail 44 is subjected to great resilient deformation and therefore is liable to be subjected to the stress by repetitive load, but by using the resilient plate 43 of a material strong to repetitive load as in the present embodiment, it becomes difficult for the rail to be subjected to the influence of a variation with time.

Also, in the embodiment of FIG. 9, the rising angles are made to differ from each other, whereas in the present embodiment, the rising positions of the rails 44*a* and 44*b* are made to differ from each other so that the timing at which the atmosphere release valve 39 is closed may be delayed in time with respect to capping and the interior of the space 17*b* may not be pressurized during the capping by the cap.

[Sixth Embodiment]

Figure 13:
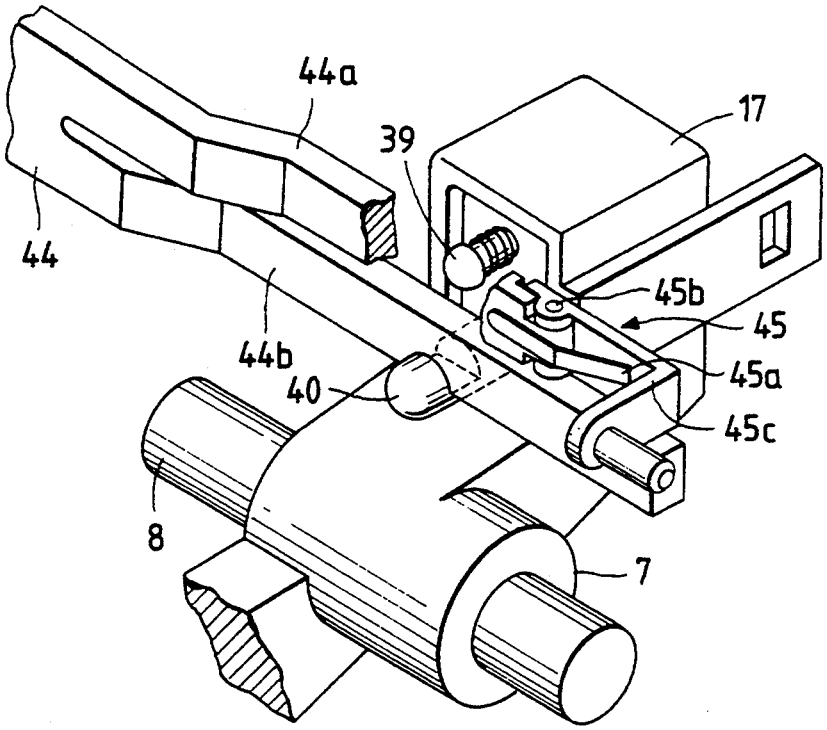

FIG. 13 is a schematic perspective view showing the essential portions of a sixth embodiment of the present invention.

In the embodiment of FIG. 12, the atmosphere release valve 39 is driven by the use of the resilient plate 43, whereas in the present embodiment, a movable portion 45 is provided on the back of a rail in the mounting portion for the atmosphere release valve. Therefore, the fore end portion of the upper rail 44*a* is separated, a leaf spring 45*a* is fixed to the body side and the fore end thereof presses the rail 44*c* on the separated side. The rail 44*c* is pivotally coupled to the end portion of the rail 44*a* by a hinge 45*b*. In this construction, the rail 44*a* is not resiliently deformed, but the rail 44*c* pivots about the hinge 45*b*. In this case, the resilient deformation of the rail 44*a* is not utilized and therefore, fatigue destruction or cracks attributable to the repetition of resilient deformation does not occur to the rail 44*a*.

Although the hinge has been shown as being provided at one location, hinges may also be provided at a plurality of locations. By providing a plurality of hinges, the freedom of movement of the rail is increased and a varying movement can be obtained. Also, the hinge has been shown as being provided on the upper rail, but alternatively, it may be provided on the lower rail.

[Seventh Embodiment]

Figure 14:
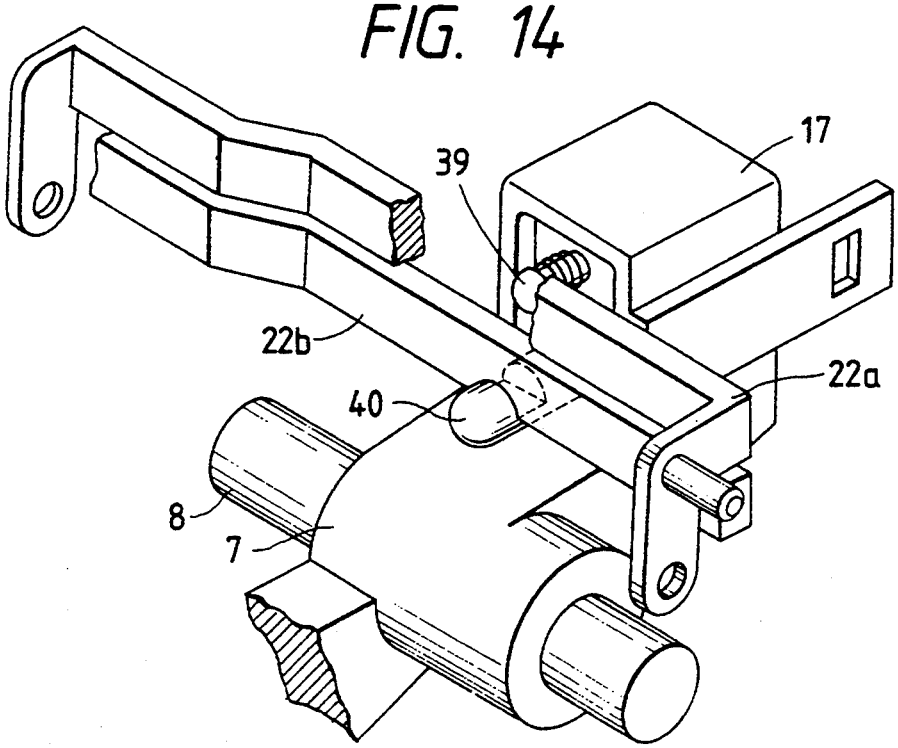

FIG. 14 is a schematic perspective view showing the essential portions of a seventh embodiment of the present invention.

In each of the aforedescribed embodiments, the opening and closing of the atmosphere release valve 39 is effected by the use of the resilient deformation of the rail, whereas in the present embodiment, the opening and closing of the atmosphere release valve is effected by moving the entire rail 22 (in the present embodiment, moving it in the vertical direction). A drive source for the movement of the rail 22 can be achieved by parallel-moving the rail perpendicularly to the plane of movement thereof by an unshown pump cam (or other means). Accordingly, in this construction, the rails 22*a* and 22*b* are not integral with each other, but are independent of each other. Although only the upper rail 22*a* is shown, it is also possible to move the lower rail 22*b* in a similar manner to thereby effect the opening and closing of the cap 17.

[Eighth Embodiment]

Figure 15:
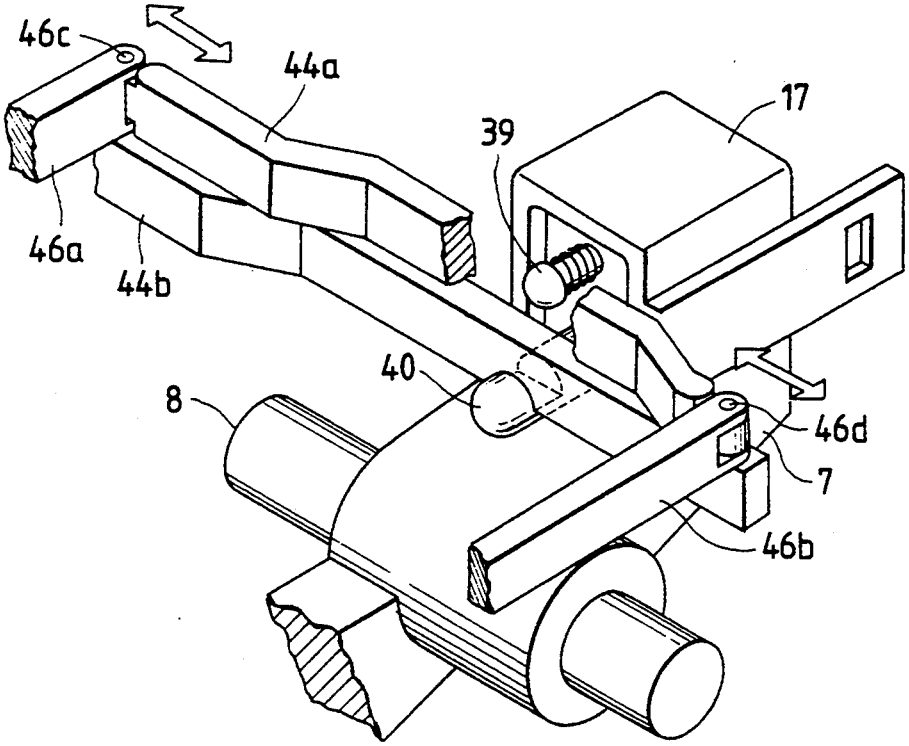

FIG. 15 is a schematic perspective view showing the essential portions of an eighth embodiment of the present invention.

In this embodiment, the upper rail 44*a* and lower rail 44*b* of the rail 44 of FIG. 13 are separated from each other and the opposite sides of the upper rail 44*a* are supported by a pair of arms 46*a*, 46*b* and a pair of hinges 46*c*, 46*d* so that the entire upper rail 44*a* can move in the direction of movement of the carriage (the horizontal direction). The upper rail 44*a* has an inclined portion in the direction of thickness thereof, and the atmosphere release valve 39 moves up and down along the inclined portion in conformity with the movement of the upper rail 44*a*, whereby the opening and closing of the valve is effected.

Again in the present embodiment, not only the upper rail 44*a* but also the lower rail 44*b* can be designed to be moved. In this case, by each rail being independently moved to the left and right, the opening-closing drive of the atmosphere release valve 39 and cap 17 can be accomplished.

[Ninth Embodiment]

Figure 16:
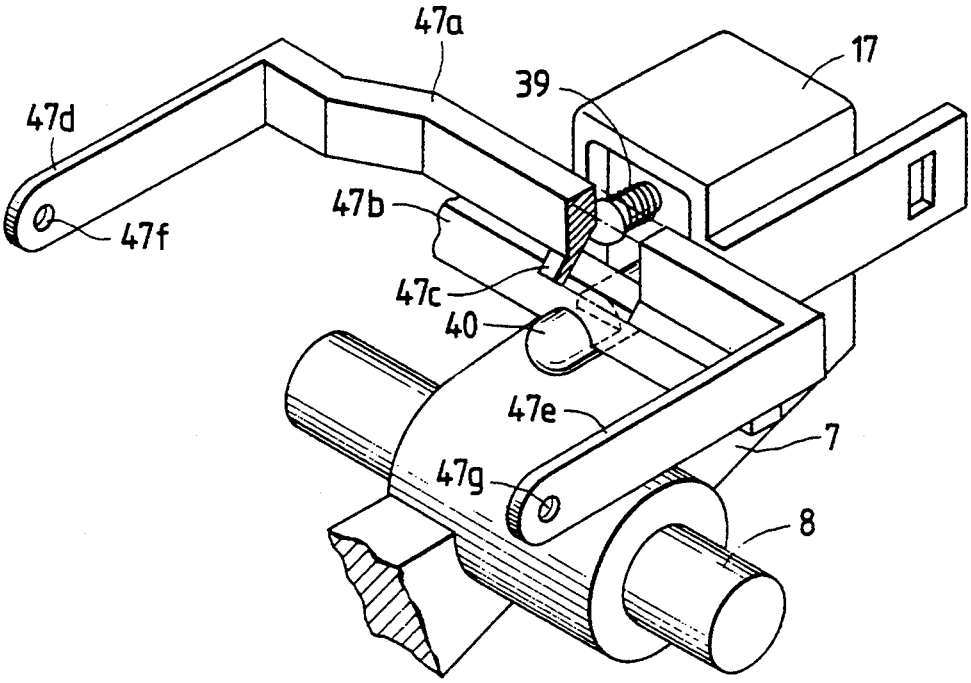

FIG. 16 is a schematic perspective view showing the essential portions of a ninth embodiment of the present invention.

In each of the aforedescribed embodiments, the rails are of rectangular cross-sectional shape, whereas this embodiment is characterized in that use is made of an upper rail 47*a* having in the lower portion thereof a protrusion 47*c* protruding in the direction opposite to the cap 17 and this upper rail 47*a* is made vertically movable. In this embodiment, the atmosphere release valve 39 is closed when the upper rail 47*a* is moving so that the flat surface thereof may bear against the atmosphere release valve 39. When the upper rail 47*a* is moving upwardly, the protrusion 47*c* is opposed to the atmosphere release valve 39 and the latter is opened.

In this case, as shown in FIG. 16, centers of rotation 47*f* and 47*g* can be provided in the end portions of arms 47*d* and 47*e* formed at the opposite ends of the rail and design can be made such that the upper rail 47*a* is pivoted with those centers of rotation as a fulcrum.

In FIG. 16, there has been shown an example in which the protrusion 47*c* is formed on the upper rail 47*a* and the latter is pivoted, but there can also be adopted a construction in which a protrusion 47c is provided on the lower rail 47b and the latter is moved.

In a suction recovery device in a liquid jet recording apparatus in which the discharge port surface of a recording head is capped by a cap in response to the movement of a carriage carrying said recording head thereon and which is provided with an atmosphere release valve for introducing the atmosphere into said cap after the suction of ink from the discharge ports, provision is made of one or more rails disposed on the back of said cap in parallelism to the direction of movement of said carriage and having resiliency, and driving means for effecting the back and forth drive of said cap and the opening-closing drive of said atmosphere release valve by the use of the pressure force of said rail deformed in conformity with the contact movement of an actuating member moving in response to the movement of said carriage and therefore, it becomes possible to effect the capping drive of the cap and the opening-closing drive of the atmosphere release valve without providing an exclusive actuating member of complicated construction.

In the suction recovery device in the liquid jet recording apparatus, at least the movable end side of said rail or rails is formed of a resiliently deformable material or a portion of said rail or rails uses a material differing from the material of the essential portion thereof or a hinge is provided, whereby said pressure force can be provided simply.

In the suction recovery device in the liquid jet recording apparatus, said rail or rails are moved and therefore, the driving for the back and forth movement of the atmosphere release valve and the carriage can be accomplished by a simple construction like that which endows the rail or rails with a resilient force.

Reference is now had to FIGS. 17 to 21 to describe an ink jet recording apparatus provided with a recovery device in which a cap of elastic material is urged against the discharge port surface of a recording head to produce negative pressure in said cap and suck ink in the discharge ports and a flow path for communicating the interior of said cap with the atmosphere and a pressure contact portion for an opening-closing valve member are provided in said cap or a portion integral therewith, whereby the joint portion of a tube can be eliminated to thereby eliminate a problem of disconnection or the like and the assembling work can be improved and moreover, even if the cap moves, the position thereof relative to the opening-closing valve can be maintained as it is and the hermetically sealing function of said opening-closing valve can be improved.

Description will also be made of an ink jet recording apparatus in which, in addition to the above-described construction, positioning means for fitting to a carriage carrying the recording head thereon is provided on a cap supporting member for supporting said cap, whereby the positional deviation between the cap and the discharge port surface can be eliminated to thereby enable the recovery operation to be accomplished more reliably.

Description will also be made of an ink jet recording apparatus provided with a recovery device in which, in addition to the above-described construction, a cap holder for holding said cap is pivotally mounted on said cap supporting member, whereby the intimate contact of the cap with the discharge port surface of the recording head can be enhanced easily.

Description will further be made of an ink jet recording apparatus provided with a recovery device in which, in addition to the above-described construction, said opening-closing valve member is carried on said cap holder, whereby the hermetically sealing function of the opening-closing valve for atmosphere release during the opening thereof can be further improved easily.

Figure 17:
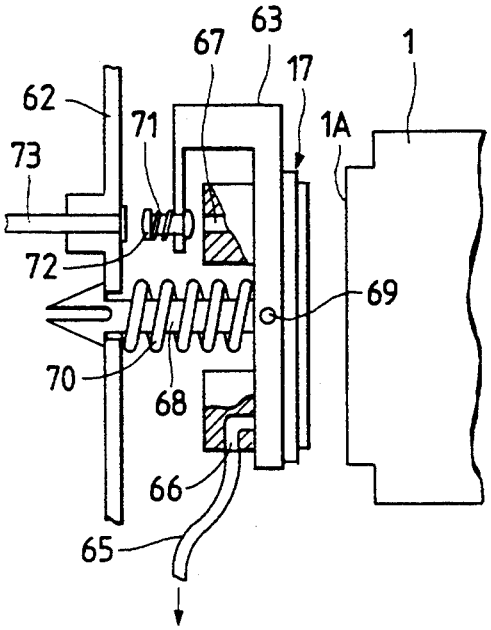
FIG. 17 is a side view showing the state when the cap of the recovery device in the ink jet recording apparatus according to the present invention is opened.

Referring to FIG. 17, in the back of the cap 17 formed of an elastic material such as rubber or plastic, there are formed a negative pressure introduction hole 66 to which is connected a tube 65 leading to the suction pump 22, and a flow path 67 for communication with the atmosphere.

The cap 17 is integrally held by a cap holder 63.

The cap holder 63 is supported on a cap carriage 62 for movement in the longitudinal direction thereof through a support rod 68, a support pin 69 and a return spring 70 and is also supported for pivotal movement within a predetermined range about the support pin 69.

A valve member 72 biased in a direction to open by a valve spring 71 is mounted at a location on the cap holder 63 which is opposed to the flow path 67.

This valve member 72 is for opening and closing the flow path 67 to thereby communicate the interior of the cap 17 with the atmosphere and cut off the communication.

Further, a push pin 73 for operating the valve member 72 is slidably mounted on the cap carriage 62.

Figure 20:
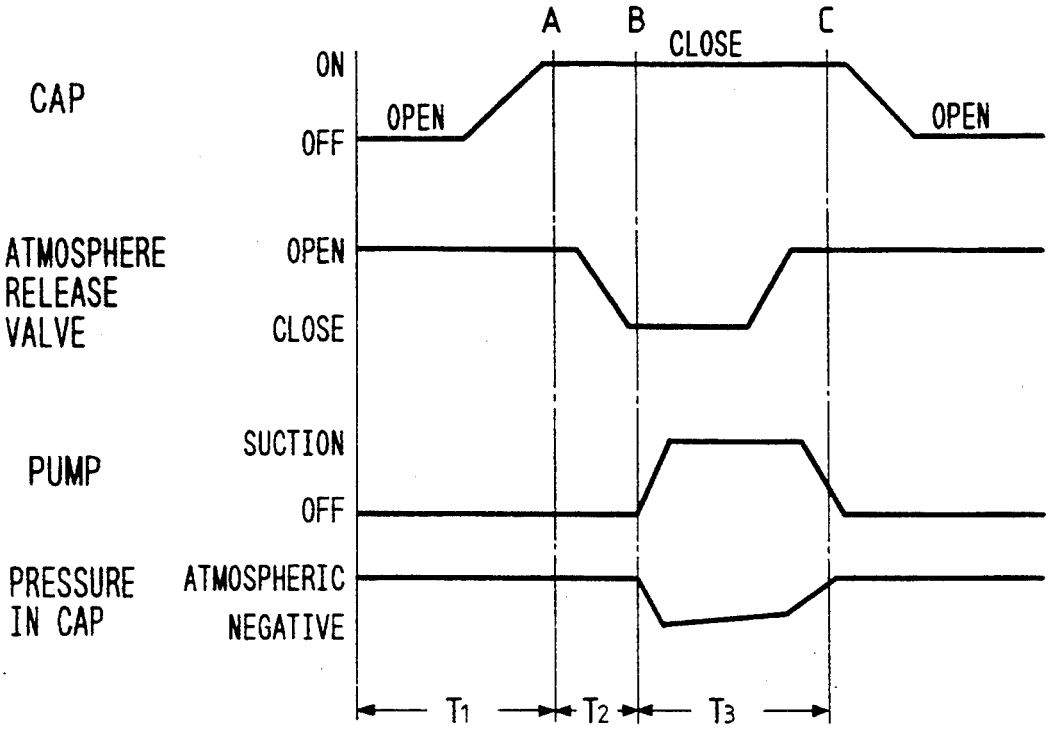
FIG. 20 is a perspective view of the ink jet recording apparatus according to the present invention.

FIG. 20 is a time chart showing the operations of the cap 17, the atmosphere release valve (valve member 72) and the suction pump 22 of the recovery device of FIG. 17 and a variation in the pressure in the cap 17.

The operation of the suction recovery device in the ink jet recording apparatus according to the present invention will hereinafter be described with reference to FIGS. 17–20.

In FIG. 17 which shows the state at the starting point of time in FIG. 20, the cap 17 is opened, the atmosphere release valve 72 is opened, the suction pump 22 is stopped from operating and the interior of the cap 17 is in the atmospheric pressure state.

Figure 18:
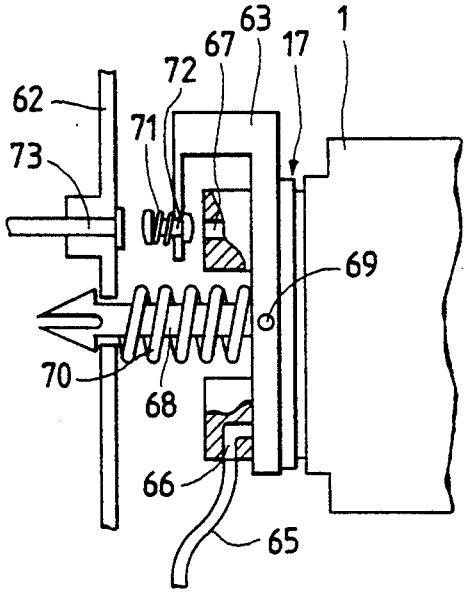
FIG. 18 is a side view showing a state in which the cap is pressed by the recovery device of FIG. 17 and the atmosphere release valve is opened.

In FIG. 18 which shows the state at a point of time A which is $T_1$ after the start of the operation in FIG. 20, the cap 17 envelops the discharge port surface 1A of the recording head 1, and the atmosphere release valve 72 is shown as being opened.

The pump 22 is not yet in operation.

At this time, the interior of the cap 17 is in the atmospheric pressure state and the pressurization in the discharge ports of the recording head by the cap 17 being elastically deformed during capping to thereby decrease the volume in the cap 17 is prevented.

Figure 19:
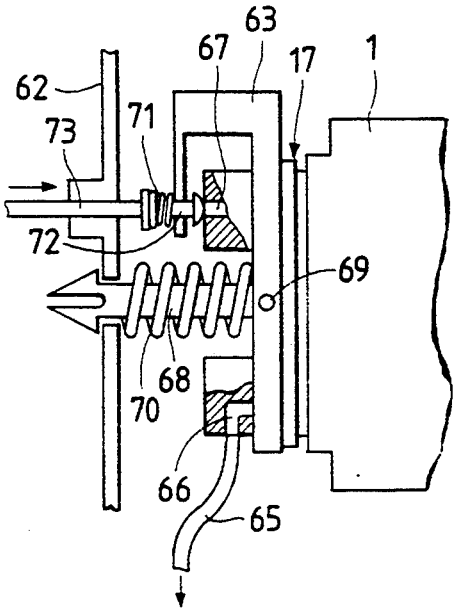
FIG. 19 is a side view showing a state in which the atmosphere release valve is urged and shut off with the cap pressed.

FIG. 19 shows the state at a point of time B which is $T_1+T_2$ after the start of the operation.

In this state, the push pin 73 is pushed in the direction of arrow by a drive source, not shown, to push the atmosphere release valve 72 into pressure contact with the end surface of the flow path 67 (the portion pressure-contacted by the opening-closing valve member 72), whereby the flow path 67 for communication with the atmosphere is shut off.

So, from this point of time, the suction pump 22 is driven to suck the air in the cap 17 and bring the interior of the cap 17 into a negative pressure state.

The ink in the discharge ports of the recording head 1 is sucked out by this negative pressure.

While the negative pressure of the pump 22 is being produced after the ink suction has been effected for a predetermined time, the push pin 73 is retracted to open the valve member (atmosphere release valve) 72 and thereby communicate the interior of the cap 17 with the atmosphere.

In FIG. 20, a point of time C after the lapse of time $T_3$ from the point of time B corresponds to the time when this communication with the atmosphere is being effected.

Also, the state of the recovery device during the communication with the atmosphere is the same as the state of FIG. 17.

The airstream created by the communication with the atmosphere being thus effected while there is the suction force of the pump is utilized to blow off ink droplets adhering to the discharge port surface 1A of the recording head 1 and also suck out the ink collected in the cap 17.

FIG. 19 shows a state in which the cap 17 is in its enveloping position and the atmosphere release valve 72 also is in its enveloping position, that is, a state when the ink is sucked.

In this case, relative positional deviation by the tolerance of fit between the projection 61 of the carriage 2 and the hole 64 in the cap carriage 62 or positional deviation relative to the cap carriage 62 due to the rotation of the cap 17 about the support pin 69 occurs, but in the above-described embodiment, the opening-closing valve member (atmosphere release valve) 72 is mounted on the cap holder 63 integrally coupled to the cap 17 and therefore, the valve member 72 does not positionally deviate relative to the flow path 67 for communication with the atmosphere and the flow path 67 is reliably enveloped.

According to the embodiment described above, the flow path 67 for communication with the atmosphere is formed in the cap 17 itself and the valve member 72 for opening and closing the flow path 67 is mounted on the cap holder 63 (the portion which is substantially integral with the cap 17) integrally assembled to the cap 17 and therefore, there is provided an ink jet recording apparatus provided with a recovery device in which, as compared with the prior-art structure, the joint portion of the tube can be eliminated to eliminate a problem of disconnection or the like and the assembly work can be improved and moreover, even if the cap 17 moves, the position thereof relative to the opening-closing valve 72 can be maintained as it is and the hermetically sealing function of the opening-closing valve 72 can be improved.

Figure 21:
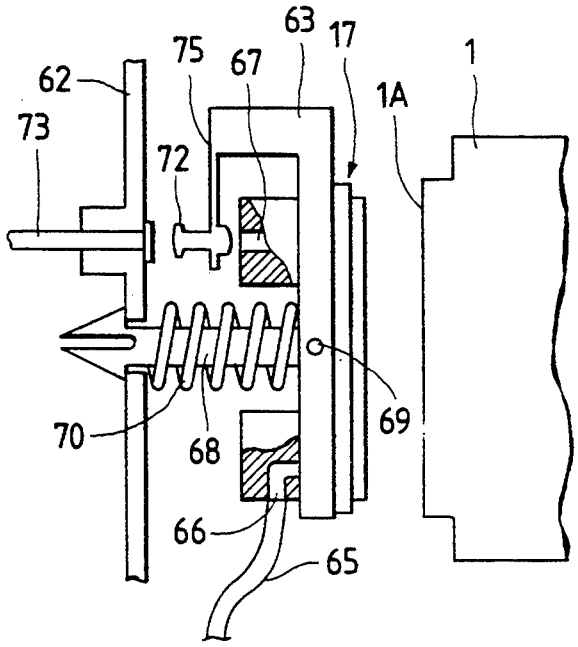
FIG. 21 is a side view showing the structure of another embodiment of the recovery device in the ink jet recording apparatus according to the present invention.

FIG. 21 is a side view showing another embodiment of the atmosphere release valve of the recovery device in the ink jet recording apparatus according to the present invention.

In this embodiment, an atmosphere release valve (valve member) 72 is formed integrally with the cap holder 63, and this valve member 72 is supported on the body portion of the cap holder 63 by a spring portion 75 of small cross-sectional area having a spring property.

This embodiment differs only in this point from the embodiment of FIGS. 17–19 and is substantially similar in the other points to the embodiment of FIGS. 17–19, and these similar points need not be described in detail.

According to this embodiment, the same effect as that of the above-described embodiment is obtained and in addition, the number of parts can be decreased to reduce the cost.

Although not shown, the atmosphere release valve 72 may also be of the type which opens and closes the flow path 67 by a rotating movement using a link, instead of a straight movement.

As is apparent from the foregoing description, there is provided an ink jet recording apparatus provided with a recovery device in which a cap of elastic material is urged against the discharge port surface of a recording head and negative pressure is produced in said cap to suck the ink in the discharge ports and in which a flow path for communicating the interior of said cap with the atmosphere and a portion pressure-contacted by an opening-closing valve member are provided in said cap or a portion integral therewith and therefore the joint portion of a tube can be eliminated to eliminate a problem of disconnection and the assembling work can be improved and moreover, even if the cap moves, the position thereof relative to the opening-closing valve can be maintained as it is and the hermetically sealing function of the opening-closing valve can be improved.

There is also provided an ink jet recording apparatus in which, in addition to the above-described construction, positioning means for fitting to a carriage carrying a recording head thereon is provided on a cap supporting member for supporting said cap and therefore the positional deviation between the cap and the discharge port surface of the recording head is eliminated to thereby enable the recovery operation to be performed more reliably.

What is claimed is:

1. A method of recovery of a liquid jet recording apparatus having a movable recording head with at least one discharge port, a cap member with a communication path to the atmosphere and a rail member for guiding said cap member, the method comprising the steps of:

covering a discharge port surface with said cap member to form an enclosed space by moving said cap member and said recording head along said rail member;

closing said communication path to the atmosphere by moving said cap member and said recording head along said rail member;

introducing gas into said discharge port by pressurizing said enclosed space changed from a space formed by said cap member and said recording head by closing said communication path;

withdrawing liquid and said gas from said enclosed space while said communication path is closed by changing pressure in said enclosed space; and using said rail member to open said communication path and vent said enclosed space in the course of withdrawing said liquid and gas from said enclosed space.

2. A method of suction recovery according to claim 1, wherein said rail member is moved to open said communication path.

3. A method of suction recovery according to claim 2, further comprising the step of reclosing said communication path to the atmosphere by moving said rail member after termination of said withdrawing step.

4. A method of suction recovery according to claim 1, wherein said closing step is performed after said covering step.

5. A method of suction recovery according to claim 1, wherein an engaging section holds said cap member, and said rail member includes a level difference portion with a fore end projecting toward said recording head for cooperating with said engaging section.

6. A method of suction recovery according to claim 5, wherein said rail member includes a first rail for cooperating with said engaging section and a second rail for cooperating with a valve member that controls said atmospheric communication path.

7. A method of suction recovery according to claim 6, wherein said second rail includes an elastically deformable section.

8. A method of suction recovery according to claim 1, further comprising the step of rubbing a member made of flexible material against said discharge port surface.

9. A method of suction recovery according to claim 1, wherein said recording head is mounted on a movable carriage for scanning said recording head to perform recording and for moving said cap member and said recording head along said rail member.

10. A method of suction recovery according to claim 1, wherein said recording head has a heat generating element for generating energy to be used for discharging ink.

11. A method of suction recovery according to claim 1, wherein said recording head has a piezo-electric element for generating energy to be used for discharging ink.

12. A method of suction recovery according to claim 1, further comprising the step of sensing the position of said recording head to control the method.

* * * * *